United States Patent [19]

Johnson

[11] 4,447,969

[45] May 15, 1984

[54] BOOT FOR WALKING ON SOFT MATERIALS

[76] Inventor: James R. Johnson, 4361 Ivory Way NE., Salem, Oreg. 97301

[21] Appl. No.: 348,336

[22] Filed: Feb. 12, 1982

[51] Int. Cl.[3] ..... A43B 5/04
[52] U.S. Cl. ..... 36/116
[58] Field of Search ..... 36/116

[56] References Cited

U.S. PATENT DOCUMENTS 3,747,236 7/1973 Sidlauskas ..... 36/116
3,783,532 1/1974 Harradine ..... 36/116

*Primary Examiner*—Patrick D. Lawson
*Attorney, Agent, or Firm*—Charles N. Hilke

[57] ABSTRACT

A boot or a boot add-on for walking on sand, mud, snow, marshes, or other soft material with moveable wings that open to increase the surface area which prevents sinking into the soft material.

4 Claims, 7 Drawing Figures

FIG. 5
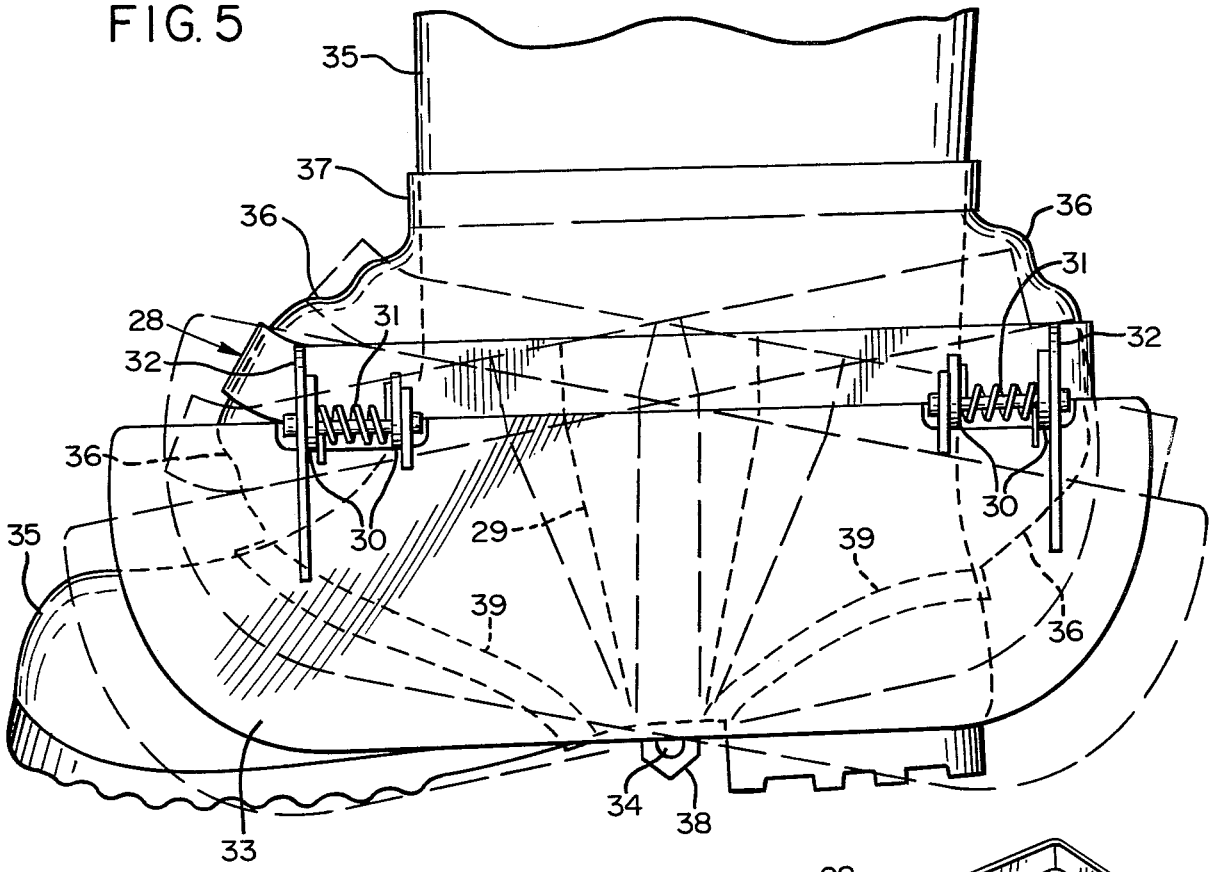
FIG. 6
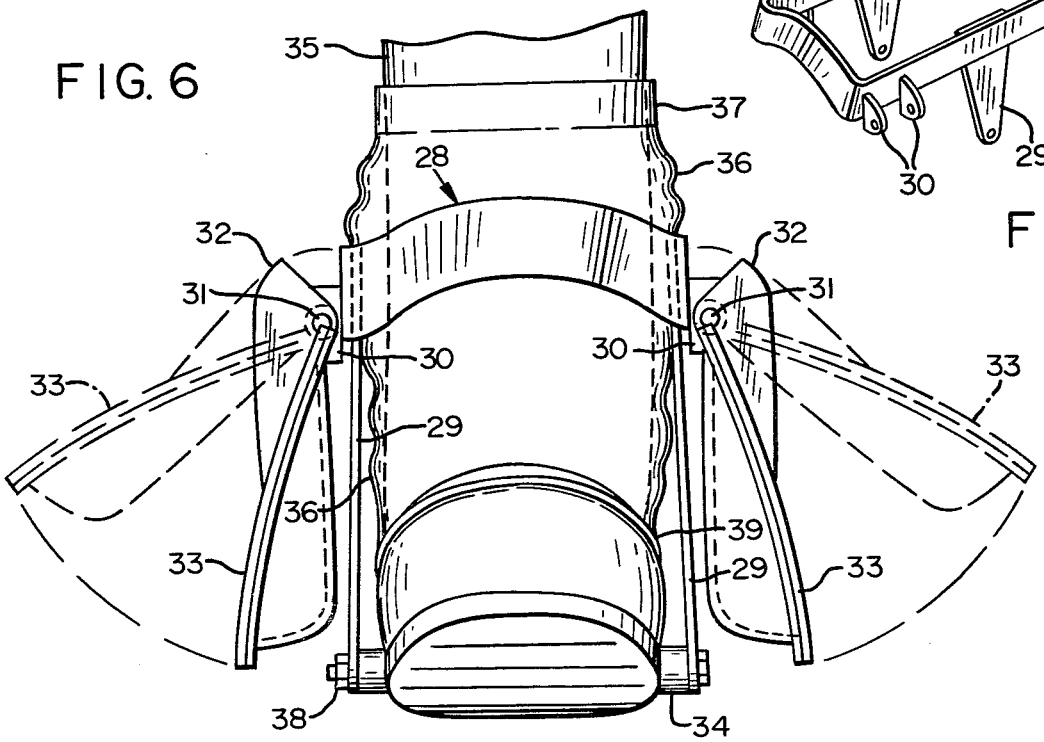
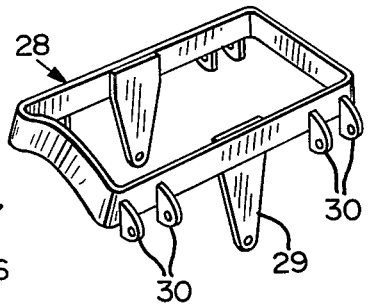
FIG. 7

BOOT FOR WALKING ON SOFT MATERIALS

BACKGROUND OF THE INVENTION

This invention relates to a device for walking on soft materials. Previous patents have been granted in this general area. U.S. Pat. No. 683,595 discloses a broad circular surface with straps to hold the foot or shoe with a tube designed to release suction attached to the base of the circular support. U.S. Pat. No. 1,059,565 discloses a swimming shoe along with a pivot for walking on the ground. U.S. Pat. No. 1,255,492 discloses an eliptical shoe which contains a flexible canvas on the underside of the shoe in order to overcome the suction when walking in soft material. U.S. Pat. Nos. 2,367,219 and 3,082,548 disclose wing attachments for increasing the surface area.

U.S. Pat. No. 2,484,389 discloses a pivot with an undersole to maintain the shoe sole horizontal.

An examination of this prior art shows complex designs or inflexible designs which prevent ready use of these kinds of devices.

SUMMARY OF THE INVENTION

The present invention uses two appropriately hinged and supported wings which open on contact with the soft material. There are two embodiments: one is a slipper-like attachment which includes the speading wings, or pair of slip-on wings which may be attached directly, or indirectly, to an ordinary pair of boots.

With the foregoing in mind, it is the primary object of the invention to provide a simply designed and easily used footwear to prevent sinking in soft ground material.

A further object is to provide safety to workers and sportsmen in areas where they may readily sink through soft material and be endangered, for example, in mud flats near tidal areas.

It is a further object to provide a design which allows the person to walk safely on hard ground or a boat without the necessity of removing and replacing the boot or wing attachment. The design allows relatively free foot movement on hard surfaces because it maintains its minimum width and has no protruding parts that extend below the sole of the boot. Another important feature, unlike previous art, is that the attachment is in its minimum width when the foot is lifted from a soft surface which facilitates foot and leg movement. It greatly reduces the necessity for the wearer to spread legs to avoid colliding when taking steps. Also, the rocking action provides stability when taking steps because the wings maintain a relatively level position when the wearer's weight is transferred from one foot to the other. This prevents the wings from diving when the foot is tilted.

To the accomplishment of the foregoing and related ends, the invention, then, comprises the features hereinafter fully described and the annexed drawing setting further in detail certain illustrative embodiments of the invention, these being indicative, however, of but several of the various ways in which the principle of the invention may be employed.

BRIEF DESCRIPTION OF THE DRAWINGS

So that the invention may be readily made, reference is made to the accompanying drawings:

FIG. 5 is a side view of the slip-on wing design which also shows the rocking and pivoting movements about the axle.

FIG. 6 is a front view showing the wings expanded and in down position.

FIG. 7 is a view of the rocking member.

DETAILED DESCRIPTION OF THE INVENTION

Figure 1:
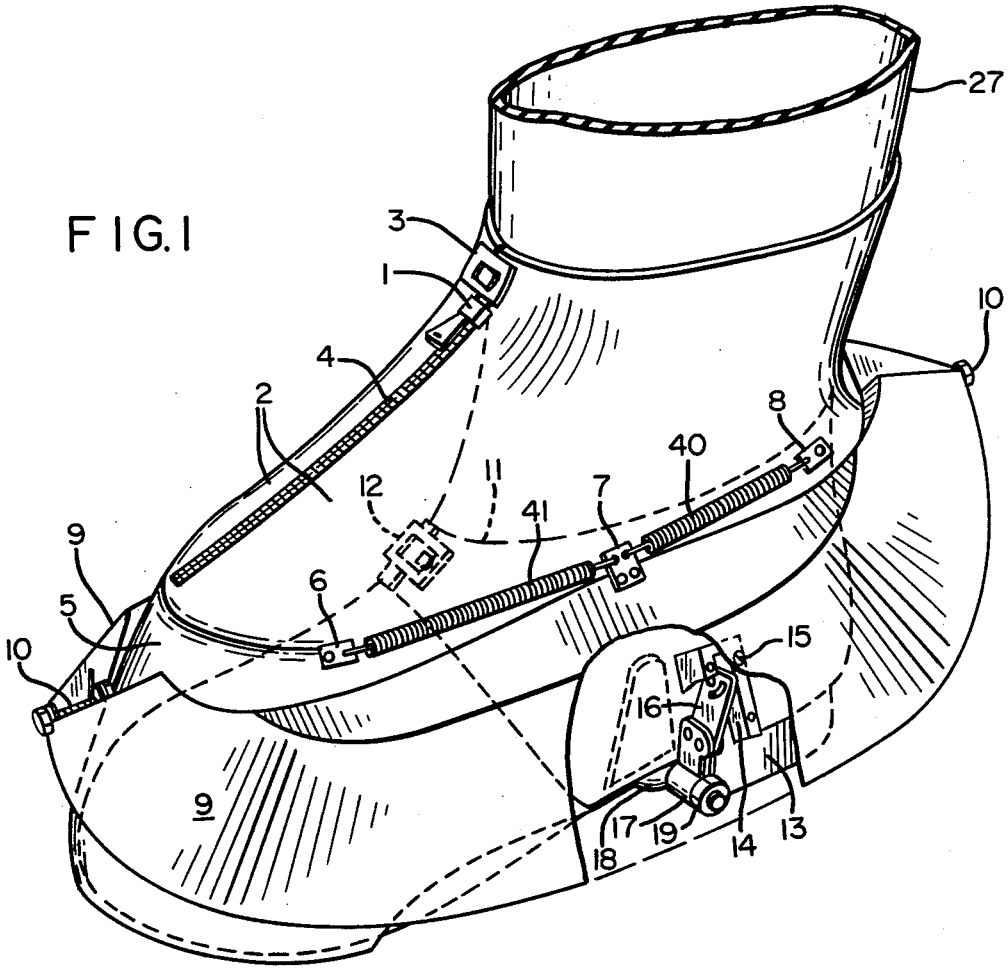
FIG. 1 is a perspective view of the entire boot construction with a cut-away detail of the main support structure and the pivoting and rocking structure for the wings.

FIG. 1 shows the embodiment for the entire boot construction. The boot 27 into which the foot fits is built up by the contoured boot cover 5 and the mud guard 2. The mud guard buckle 3 and the zipper 1 and zipper track 4 close the mud guard 2. The forward spring eyes 6 and the aft spring eyes 8 are connected to the contoured boot cover 5. The center spring eyes 7 are connected to the contoured wings 9. The aft spring 40 and the forward spring 41 provide returning tension to the normal position of the wings 9. Outside the boot 27 and inside the mud guard 2 is the strapping 11 and the strapping buckle 12 to hold the boot securely within the contoured cover 5. Next to the heel 13 is the axle (shown in FIG. 4 number 18) along with the upper bearing block 14 and the lower bearing pivoting block 17. Also shown is the link 16. The wings 9 are connected by a wing spring hinge forward and aft 10 or other spring arrangement incorporated within the wing assembly.

Figure 2:
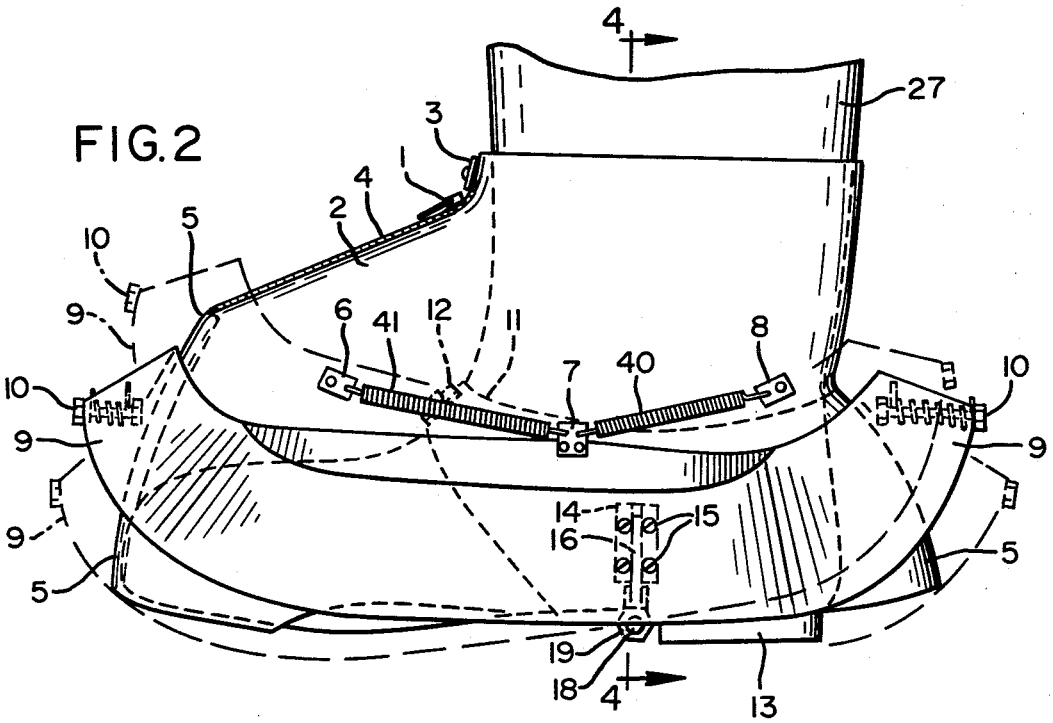
FIG. 2 is a side view of the entire boot construction showing the rocking action of the wings about the axle.

FIG. 2 shows the rocking motion about the axle 18. Again, the contoured boot cover 5 is most clearly visible in this figure. The bearing block 14 is held to the wings 9 by the screws 15.

Figure 3:
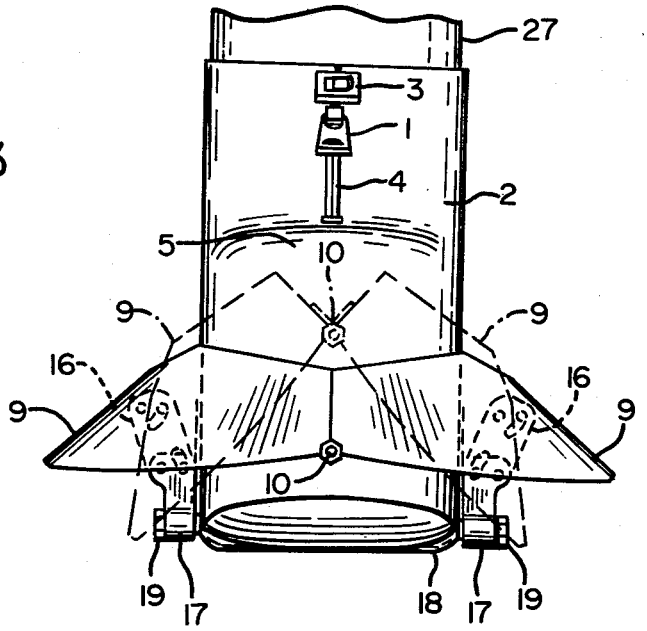
FIG. 3 is a front view showing the pivoting wings fully extended and showing the wings in resting position.

FIG. 3 is a front view showing the wings 9 in extended and rested position. The wing spring hinge 10 returns the wings 9 to rested position.

Figure 4:
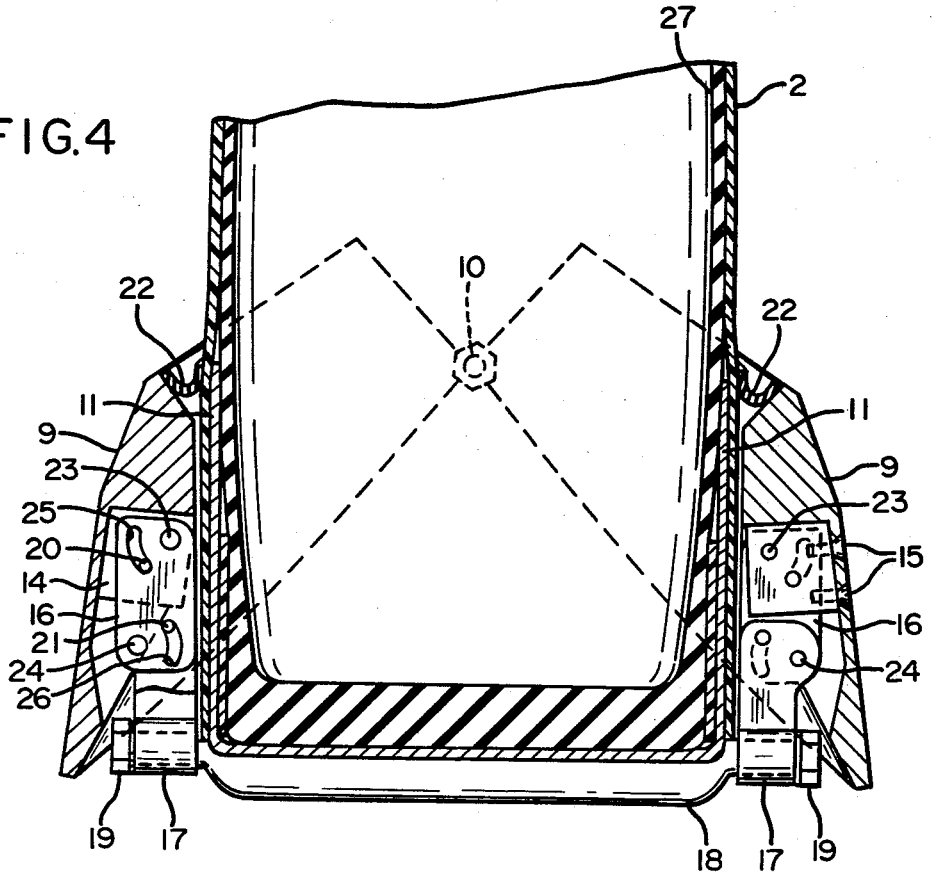
FIG. 4 is a cut-away view showing details of the rocking and the pivoting mechanism of the wings.

FIG. 4 shows the detail of the mechanism of the wings 9. The boot 27 and the mud guard 2 along with the mud seal 22 prevent mud from oozing or seeping between wings 9 and contoured boot cover 5. The mud seal 22 also prevents mud from building up on the mud guard and upper portion of the wings. The upper bearing pin 23 and the upper slot 25 with the upper stop pin 20 operate in conjunction with the lower bearing pin 24, lower slot 26, and the lower stop pin 21. The stop pins 20 and 21 prevent the wings from opening beyond set limits allowing approximately 85° wing movement. The wings opposing edges at the hinges also close in such fashion to prevent the wings from opening beyond set limits. The lock nuts 19 hold the lower bearing pivoting block 17 in place along with the axle 18.

FIGS. 5, 6, and 7 show the invention designed to accept an ordinary boot. In FIG. 7 the rocking member 28 is clearly shown. The pivot arm 29 connects to the stirrup 34 (shown in FIG. 6) and the stationary hinge 30 is connected to the rocking member 28.

FIG. 5 shows the spring 31 which is attached to the wings 33. The conventional boot 35 slips through the resilient ankle band 37 and through the flexible funnel-like apparatus which functions as a seal between the rocking member and the boot. The stirrup 34 fits into the arch of the boot. A nut 38 holds the pivot arm 29 to the stirrup 34. In FIG. 6 the reinforced raised wing stops 32 against the rocking member 28 to prevent the wings from opening in excess of 70 degrees. In FIG. 5 the resilient boot seal 39 which is the bottom of the flexible funnel-like apparatus 36 and attaches to the stirrup and prevents mud from going inside the apparatus.

In operation, FIGS. 3 and 6 shows the manner in which suction is overcome. As the wearer places his foot in the soft material, the wings expand. Thus, the surface area supporting the wearer is the surface area of the boot plus the area of each wing in expanded position. As the boot is lifted, the wings retract to their minimum width. Thus, the surface area for the suction to be overcome is essentially only the surface area of the boot. In other words, the surface area of the invention when it is bearing weight is the boot-print plus the surface area of each wing in expanded position; while the surface area of the invention when it is being lifted is the boot-print only. Thus, the suction is overcome by the normal walking movement unlike the prior art. FIG. 3 shows how the wings will open and close with each step into the mud. In the conventional boot design FIGS. 5 and 6 show the same operation of the wings.

Reviewing FIGS. 2 and 5 shows that the contoured wings, respectively 9 and 33, remain approximately parallel to the ground during the natural heel to toe movement. Furthermore, FIGS. 3 and 6 show that the material forming the ground force the wings 9 and 33 open.

It is obvious to those skilled in the art that portions of the two embodiments may be interchanged or confined. For example, the flexible funnel-like apparatus 36 could also be incorporated in the free hinge design FIGS. 1 and 2, thus eliminating contoured boot cover 5.

While the invention has been described by means of a specific example and in two specific embodiments, I do not wish to be limited thereto, for obvious modifications will occur to those skilled in the art without departing from the spirit, scope and principles of this invention.

What is claimed is:

1. A boot for walking on soft materials comprising:

a. means for engaging and disengaging a boot or foot;

b. an axle and/or stirrup;

c. a lower bearing pin, a lower stop pin, a link, and an upper bearing block connecting the axle and/or stirrup to hinged wings;

d. means to prevent fouling.

2. A boot as claimed in claim 1 wherein the link further comprises:

e. upper slot;

f. upper bearing pin;

g. lower slot; and h. lower bearing pin.

3. A boot as claimed in claim 1 wherein the upper bearing block further comprises:

i. upper bearing pin;

j. lower bearing pin; and k. means for attachment to the hinged wings.

4. A boot as claimed in claim 1 wherein the hinged wings further comprises:

m. spring or elastic means for returning the wing assembly to a horizontal position;

n. spring or elastic means for returning the wing assembly to a vertical retracted position.

* * * * *